US010316473B2

(12) United States Patent
Heerink et al.

(10) Patent No.: US 10,316,473 B2
(45) Date of Patent: Jun. 11, 2019

(54) MODULAR STRUCTURE FOR INSTALLING AN ARTIFICIAL PLAYING FIELD

(71) Applicant: Ten Cate Thiolon B.V., Nijverdal (NL)

(72) Inventors: Hein Anton Heerink, Oldenzaal (NL); Hugo de Vries, Ridderkerk (NL)

(73) Assignee: Ten Cate Thiolon B.V., Nijverdal (NL)

( * ) Notice: Subject to any disclaimer, the term of this patent is extended or adjusted under 35 U.S.C. 154(b) by 0 days.

(21) Appl. No.: 15/566,239

(22) PCT Filed: Apr. 13, 2016

(86) PCT No.: PCT/NL2016/050255

§ 371 (c)(1),
(2) Date: Oct. 13, 2017

(87) PCT Pub. No.: WO2016/167651

PCT Pub. Date: Oct. 20, 2016

(65) Prior Publication Data

US 2018/0094390 A1 Apr. 5, 2018

(30) Foreign Application Priority Data

Apr. 13, 2015 (NL) ..... 2014621

(51) Int. Cl.

| | |
|---|---|
| ***E01C 13/02*** | (2006.01) |
| ***A63C 19/00*** | (2006.01) |
| ***E01C 13/08*** | (2006.01) |
| *A41G 1/00* | (2006.01) |

(52) U.S. Cl.

CPC ..... *E01C 13/02* (2013.01); *A63C 19/00* (2013.01); *E01C 13/08* (2013.01)

(58) Field of Classification Search

CPC ..... E01C 13/00; E01C 13/02; E01C 13/08; E01C 13/083; A41G 1/00; A41G 1/009; A01N 3/00

USPC ..... 472/88–92; 482/17, 92, 95, 87

See application file for complete search history.

(56) References Cited

U.S. PATENT DOCUMENTS

| | | | | |
|---|---|---|---|---|
| 6,221,445 | B1 * | 4/2001 | Jones | E01C 13/08 405/36 |
| 7,638,077 | B2 | 12/2009 | Gaskarth | |
| 9,260,823 | B2 | 2/2016 | Craven | |
| 9,388,536 | B2 | 7/2016 | De Vries | |

(Continued)

FOREIGN PATENT DOCUMENTS

| | | |
|---|---|---|
| WO | 01/05257 A1 | 1/2001 |
| WO | 2004097117 A1 | 11/2004 |

(Continued)

*Primary Examiner* — Kien T Nguyen

(74) *Attorney, Agent, or Firm* — N.V. Nederlandsch Octrooibureau; Catherine A. Shultz; Tamara C. Stegmann

(57) ABSTRACT

A modular structure for installing an artificial playing field comprising: a stabilizing layer forming a plurality of compartments for receiving a granular infill; a separation layer for location over the stabilizing layer to retain the infill; a water distributing layer; and an artificial turf layer. The claimed construction allows a stable base layer to be formed using virtually any locally available granular material such as earth, gravel, lava, rock and the like. The compartments ensure that the granular material is held in place and cannot be displaced due to loading or washed away due to rain or flooding.

14 Claims, 3 Drawing Sheets

(56) References Cited

U.S. PATENT DOCUMENTS

| | | | |
|---|---|---|---|
| 2005/0042394 | A1 | 2/2005 | Sawyer et al. |
| 2014/0147218 | A1 | 5/2014 | De Vries |

FOREIGN PATENT DOCUMENTS

| | | | |
|---|---|---|---|
| WO | 2016099253 | A1 | 6/2016 |
| WO | 2017/065607 | A1 | 4/2017 |

* cited by examiner

MODULAR STRUCTURE FOR INSTALLING AN ARTIFICIAL PLAYING FIELD

BACKGROUND OF THE INVENTION

1. Field of the Invention

The present invention relates to artificial playing fields and in particular to playing fields that can be easily installed yet meet a consistent specification in terms of their performance. The invention also relates to the installation of such a playing field.

2. Description of the Related Art

Various artificial and semi-artificial sport field systems are known. Semi-artificial pitches usually involve integrating artificial grass blades into a soil base in which regular turf is allowed to grow. The soil base and its drainage arrangements may be otherwise similar to conventional natural grass pitches in order to ensure correct growth of the natural grass.

Fully artificial pitches have developed from first generation Astroturf™ to the present fourth generation systems, which attempt to combine all of the functions and characteristics of natural turf into a single product. In laying an artificial pitch, one fundamental requirement is an adequate base onto which the technical layers can be laid. A significant part of the overall cost of a new installation may lie in the preparation of the base. This should provide a guaranteed level of stability and drainage despite the fact that the underlying earth may vary considerably from one location or region to another. For a contractor embarking on the installation of a new pitch, the risks involved in failing to provide and adequate base are significant. For this reason, it often occurs that the local materials are removed and replaced by imported materials over qualified composition. Transport of such enormous amounts of material is extremely expensive and makes installation of artificial pitches available only to relatively wealthy stakeholders e.g. clubs, governments or commercial parties.

There have been many efforts to introduce football and other sports to less favoured communities but despite best efforts, a cost effective and qualitatively adequate artificial pitch construction has not available that can be applied to any undersurface. Furthermore, although in some situations a firm undersurface may be available on which an artificial grass surface may be laid, once exposed to heavy rains, water damage may cause the undersurface to become eroded, leaving hollows and discontinuities in the pitch.

It would therefore be desirable to provide a structure for installing an artificial playing field that could be easily and cheaply be installed at any location with a minimum of transport of materials.

BRIEF SUMMARY OF THE INVENTION

According to the invention there is provided a modular structure for installing an artificial playing field comprising: a stabilising layer forming a plurality of compartments for receiving a granular infill; a separation layer for location over the stabilising layer; a water distributing layer; and an artificial turf layer. The claimed construction allows a stable base layer to be formed using virtually any locally available granular material such as earth, gravel, lava, rock and the like. The compartments ensure that the granular material is held in place and cannot be displaced due to loading or washed away due to rain or flooding. To this end, the stabilising layer should be of a material that is at least sufficient to retain the granular infill. The same may apply to the separation layer, in that it should retain the infill and not allow infill to pass through it, even in the case that the layer is porous.

The pockets formed in the stabilising layer preferably include sides and a base, integrally formed together. It is of course not excluded that these parts could be separately formed and joined e.g. by stitching, gluing, welding or the like. In one embodiment, the stabilising layer is a textile layer such as a geotextile. Preferably a woven textile may be used and the material may be either biodegradeable e.g. over the expected lifetime of the playing field or inert. In one embodiment, a woven polypropylene material may be used although polyester of even polyethylene may be considered. The compartments may be formed as pockets e.g. by folding of the stabilising layer and subsequent connection at the folds by stitching, gluing, welding or the like. By using a flexible stabilising layer, this layer may easily be delivered e.g. on a roll and deployed at the required location.

The size of the compartments may be determined according to the nature of the granular infill. For larger infill, larger compartments may be required and vice versa. In general, each compartment may have an area of between 20 $cm^2$ and 600 $cm^2$, preferably between 40 $cm^2$ and 200 $cm^2$.

The depth of the compartments will also be at least partly determined by the nature of the granular infill as this will at last partly define the required depth of the base. The granular infill will be filled to the rim of the compartments and should not exceed this level as any additional depth will not be stabilised and can shift. In certain embodiments, the compartments may each have a depth of between 3 cm and 15 cm, which is adequate for most purposes. In order to ensure that the stabilising layer can be multifunctional for use with a wide variety of different infill, the compartments may have a depth between 5 cm and 10 cm.

As indicated above, one of the most important requirements of a playing field, at least for external use, is its ability to correctly drain in the case of rain, flooding or sprinkling. In the case that locally available granular infill is used, its ability to drain or withstand water may not be known in advance and may not be ideal. For this reason, according to one aspect of the invention, it may be desirable to separate the drainage function from the stabilising function. This may be achieved by making the separation layer impermeable, whereby water falling onto the field will remain above the stabilising layer and not penetrate into the granular infill. In this context it will be understood that the separation layer need not be totally waterproof and need only serve to limit transport of water perpendicular through the separation layer, while encouraging transport along the separation layer through the water distributing layer. The water distributing layer may be provided in various different forms. In the case of operation with an impermeable separation layer, the water distributing layer should be able to transport water laterally to the edges of the playing field. In one embodiment this layer may comprise a porous granular structure. The porous granular structure may be laid in situ using paving techniques and an appropriate binder. In an alternative embodiment, it may comprise pre-formed tile elements of resilient, porous matrix material. One such matrix material comprises recycled plastic particulates bonded together either by melting or by the addition of a suitable binder. The degree of resilience may be tailored to the particular sport that is to be played based on the amount of binder and matrix. Rubber granules may also be used either alone or in combination with other matrix materials. An example of the use of such matrix materials is disclosed in PCT/NL2014/050896, the contents of which are incorporated herein by reference in their entirety.

In another embodiment, the water distributing layer may comprise a flexible resilient layer. In this context, a flexible resilient layer is intended to denote that it is a layer that can be rolled for storage and transport and can be unrolled during installation of the playing field. In one particular embodiment, this layer may also be woven using foamed or foamable materials. A particularly advantageous structure comprises a woven structure of closed-cell foam filaments and unfoamed fibres that is foamed subsequent to weaving. It is also possible that such a flexible resilient layer is transported in an unfoamed configuration and locally subjected to heat in order to cause the foam to expand. A material of this type is described in WO 2014/092577, the contents of which are included herein by reference in their entirety The artificial turf layer may be chosen according to the particular sport that is intended and may either comprise tufted grass fibres in a backing or a woven structure having grass fibres forming the pile. In one embodiment the artificial turf layer is a non-infill turf layer. Such a layer is particularly suitable for general use and may require less care and maintenance than an infill based system. It is also easier to deliver to a remote location for installation since one less component is required. In this context a non-infill turf layer is understood to be one that uses different fibres to achieve the function of an infill (usually sand or rubber granules), e.g. with filling fibres providing support to pile fibres. In one preferred embodiment the artificial turf layer is a woven turf layer. The invention is particularly related to the provision of a field in kit form that can be easily transported to a remote location and installed with a minimum of knowhow using only the materials delivered and local materials. The structure required for a field of more than 500 $m^2$ and even as much as 800 $m^2$ may be provided in a single 40 ft shipping container, namely a volume of around 75 $m^3$, minimising transport and logistics.

In a further development of the concept, the shipping container may be adaptable as a club house or changing facility after unloading of the contents. For this purpose, it may be already foreseen with windows and door openings and may also be provided with other facilities such as plumbing and wiring.

The invention also relates to an artificial playing field comprising a modular structure as described above and hereinafter wherein the stabilising layer is filled with a granular infill located within the plurality of compartments. The field is preferably a mini-pitch of around 20 m×40 m as this is a dimension that has been found most suited for low cost installation for bringing football to the community. It is also a dimension that can be easily transported in a single container. The granular infill may be separately sourced from the remaining components, in particular it may be locally sourced.

The invention further relates to a method of installing an artificial playing field comprising: providing a stabilising layer, a separation layer, a water distributing layer and an artificial turf layer; installing the stabilising layer onto a cleared and levelled surface; filling a plurality of compartments of the stabilising layer with a granular infill; installing the separation layer over the stabilising layer to retain the infill; installing the water distributing layer over the separation layer; and laying the artificial turf layer.

BRIEF DESCRIPTION OF THE DRAWINGS

The features and advantages of the invention will be appreciated upon reference to the following drawings of a number of exemplary embodiments, in which.

DESCRIPTION OF ILLUSTRATIVE EMBODIMENTS

Figure 1:
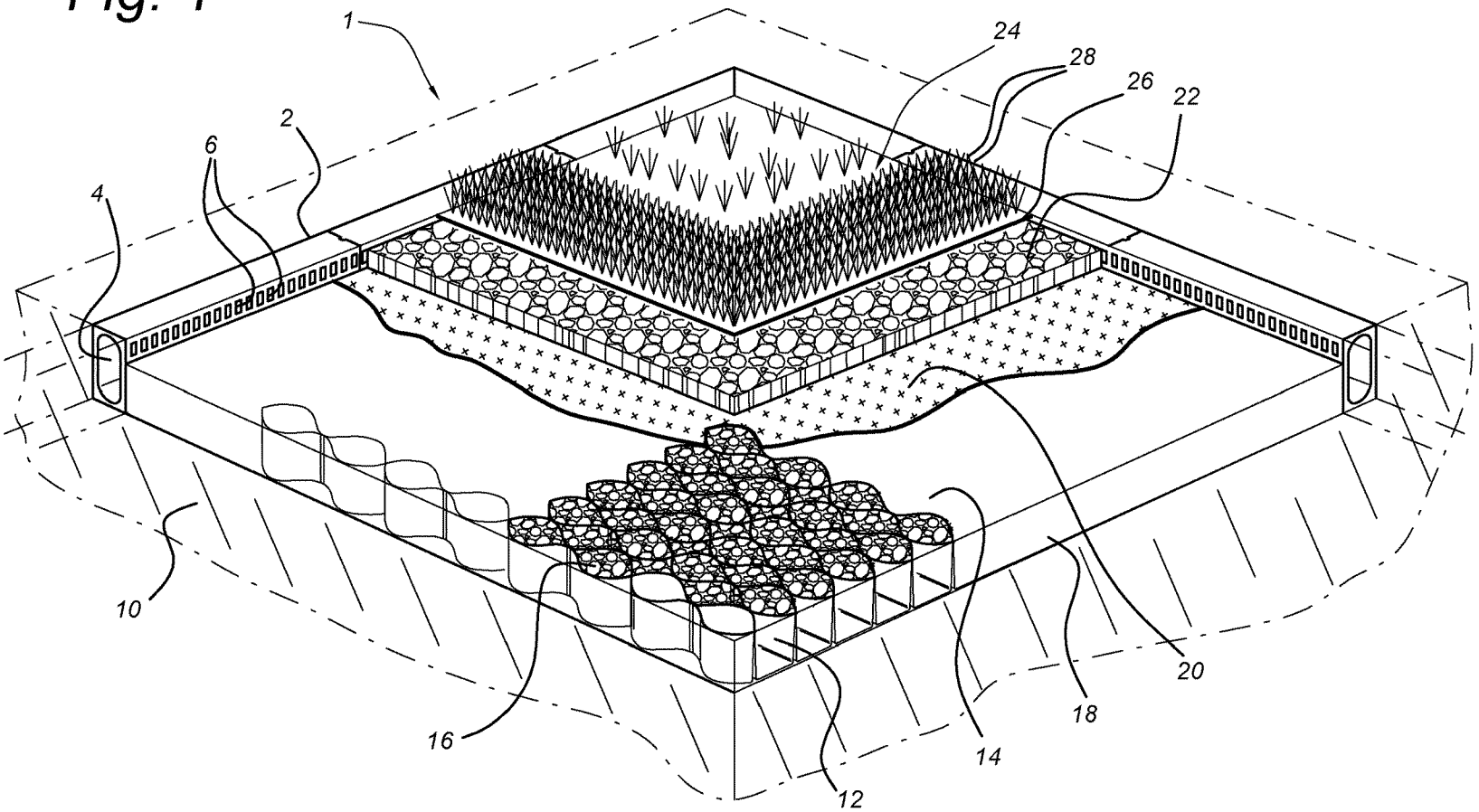
FIG. 1 shows a cut-away perspective view of part of a field according to a first embodiment of the present invention.

FIG. 1 shows a partially cut-away perspective view of an artificial playing field 1 according to a first aspect of the invention.

The field 1 is bounded by a kerb 2, which in this embodiment includes a drainage channel 4 having drainage openings 6. The kerb 2 is installed on a flat sub base 10 of earth that has been excavated to the intended depth of the field 1. It will however be understood that the field 1 may also be installed directly onto a flat area at ground level if it is sufficiently stable and an appropriate raised surround is provided to support the kerb 2.

Within the kerb 2 on top of the sub base 10 a stabilising layer 12 is laid. The stabilising layer 12 is a woven geotextile layer forming a plurality of compartments 14. The stabilising layer 12 may be of the Accorder™ type available from Ten Cate textiles having compartments 14 with a depth of 55 mm and a cross-sectional area of around 90 $cm^2$. The skilled person will understand that other alternative constructions that achieve the same effect may also be used.

The stabilising layer 12 is filled with granular infill 16 to its full depth and levelled and compacted to provide a stabilised base 18 according to the manufacturers recommended procedure. Once all of the compartments 14 have been filled, the stabilising layer 12 prevents the granular infill 16 from displacing from one compartment 14 to the other. The depth of the stabilising layer 12 is thus relatively stable even when subjected to heavy loads or flooding. The granular infill 16 may be at least partly provided by the earth excavated to create the sub base 10, if this earth is suitable for the purpose. Otherwise, other local materials may be used. A particular advantage of the stabilising layer 12 is that the choice of infill used is not critical and a wide variation of grain size can be used without detriment to the overall stability of the stabilised base 18.

On top of the stabilised base 18 there is provided a separation layer 20. The separation layer 20 according to this embodiment is a coated reinforced membrane, made from a high density polyethylene reinforced geotextile, coated on both sides with a low density polyethylene. This separation layer is available from Ten Cate Geotextiles as Nicolon C881™, although the skilled person will understand that other alternative layers may also be implemented. It spans the whole of the stabilised base 18 and serves two purposes. Firstly, it retains the granular infill 16 and secondly, it prevents water from passing into the stabilised base 18, directing it instead to the drainage openings 6. To this purpose, the separation layer 20 is located just below or level with the drainage openings 6 and may also be bonded to the kerb 2 if greater water retention is required. The kerb 2 and the separation layer 20 thus form a reservoir for all water falling onto the field 1 and the drainage channel 4 can be connected to a suitable water management system as described in co-pending application PCT/NL2014/050896.

It will be understood that in certain circumstances drainage or flooding is not an issue and in that case, the separation layer 20 may be porous and need only serve to retain the granular infill 16 and assist in distributing pressure. Woven or non-woven layers such as TenCate Polyfelt Rock™ may be ideal for this purpose. Such situations may occur in dry climates or where the stabilised base 18 ensures adequate drainage but also in situations where the field 1 is constructed indoors or otherwise protected from the weather.

Above the separation layer 20 is located a water distributing layer 22. This layer is referred to as a water distributing layer 22 as this will generally be a primary function. Nevertheless, this layer may also provide additional functions as described below and may alternatively be referred to as a technical layer. In particular, in cases where drainage is not required, it may not actually perform a drainage function. The water distributing layer 22 comprises a bound granular layer of recycled plastic granules bonded together by friction generated heat and marketed as panels under the name Ecocept™ by Ten Cate. In an alternative embodiment, this layer may be paved in-situ using a conventional paving machine and a polyurethane based binder.

Onto the water distributing layer 22 is laid an artificial turf layer 24 comprising a backing 26 and pile 28. The artificial turf layer 24 is a non-infill turf layer available from Greenfields under the name FT XP32 nf. In this construction, the pile 28 is integrated with the backing 26 and comprises a mixture of long artificial grass pile fibres and shorter fibres that act as the thatch or infill to support the grass pile fibres. This form of artificial turf layer 24 is particularly suited for general purpose use as it does not require care of the infill and is suitable for general purpose play all year round in most climates. It will nevertheless be understood that any other artificial turf layer may be used according to the requirement of the users, including both woven and tufted, with or without infill.

An important additional function of the water distributing layer 22 is as a resilient layer to provide damping and energy absorption for activities carried out on the field 1. The water distributing layer 22 in combination with the remaining layers of the field 1, primarily the artificial turf layer 24, is chosen to achieve the relevant shock absorption, energy restitution and vertical deformation criteria.

Figure 2:
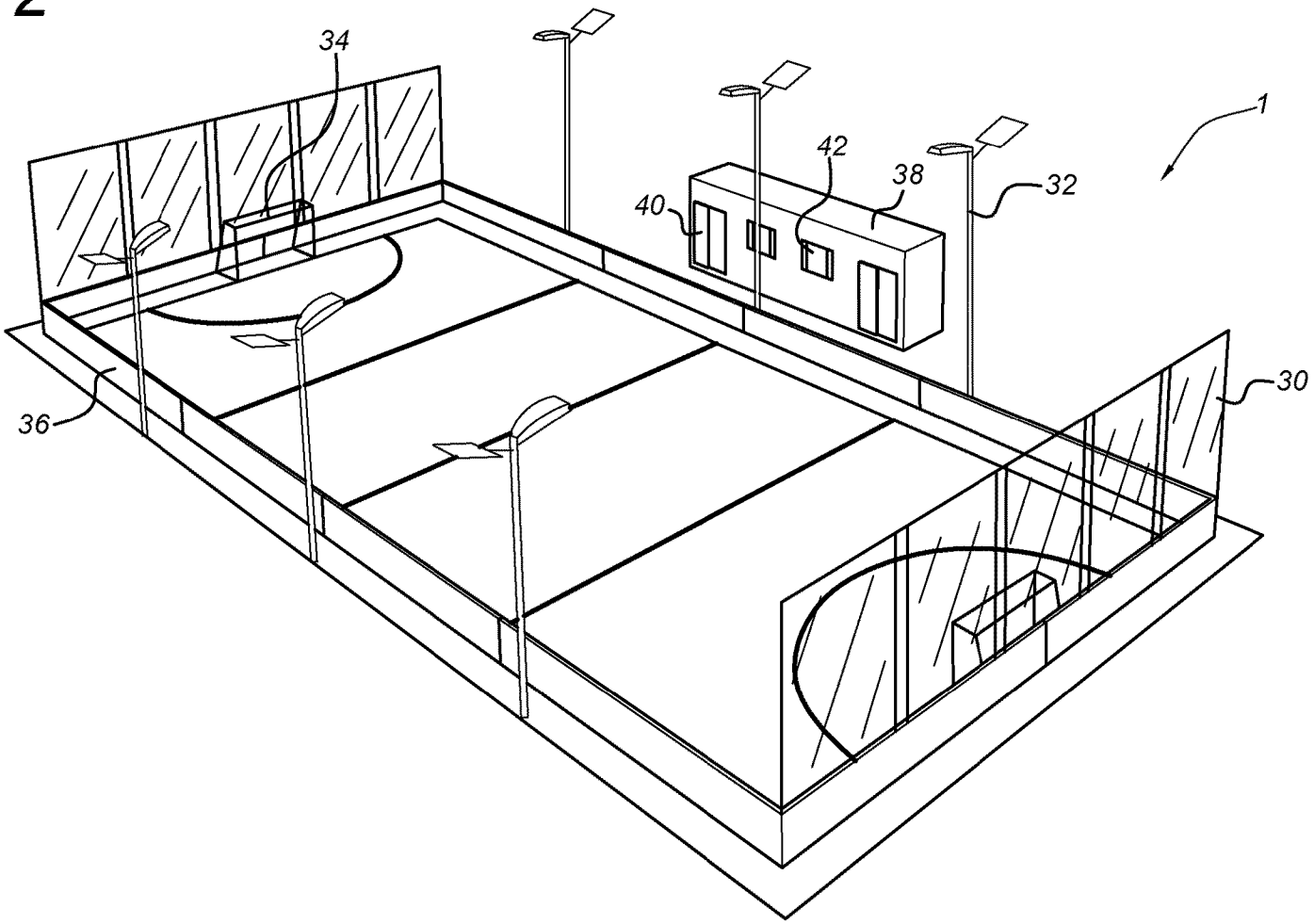
FIG. 2 shows the field of FIG. 1.

FIG. 2 shows a perspective view of the artificial playing field 1, installed and provided with fencing 30, lighting 32, goals 34 and hoardings 36. Also shown is a standard shipping container 38 that has been converted as a club house, including doors 40 and windows 42. The depicted field 1 is a 20 m×40 m mini-pitch and all of the materials for its construction can be contained in the container 38 for delivery, with the exception of the granular infill 16, which is locally sourced. Such a concept allows standardised and high quality fields to be delivered and installed at any location that a container can reach. It will of course be understood that other field dimensions may also be provided and that the concept may also be used for construction of full sized pitches.

Figure 3:
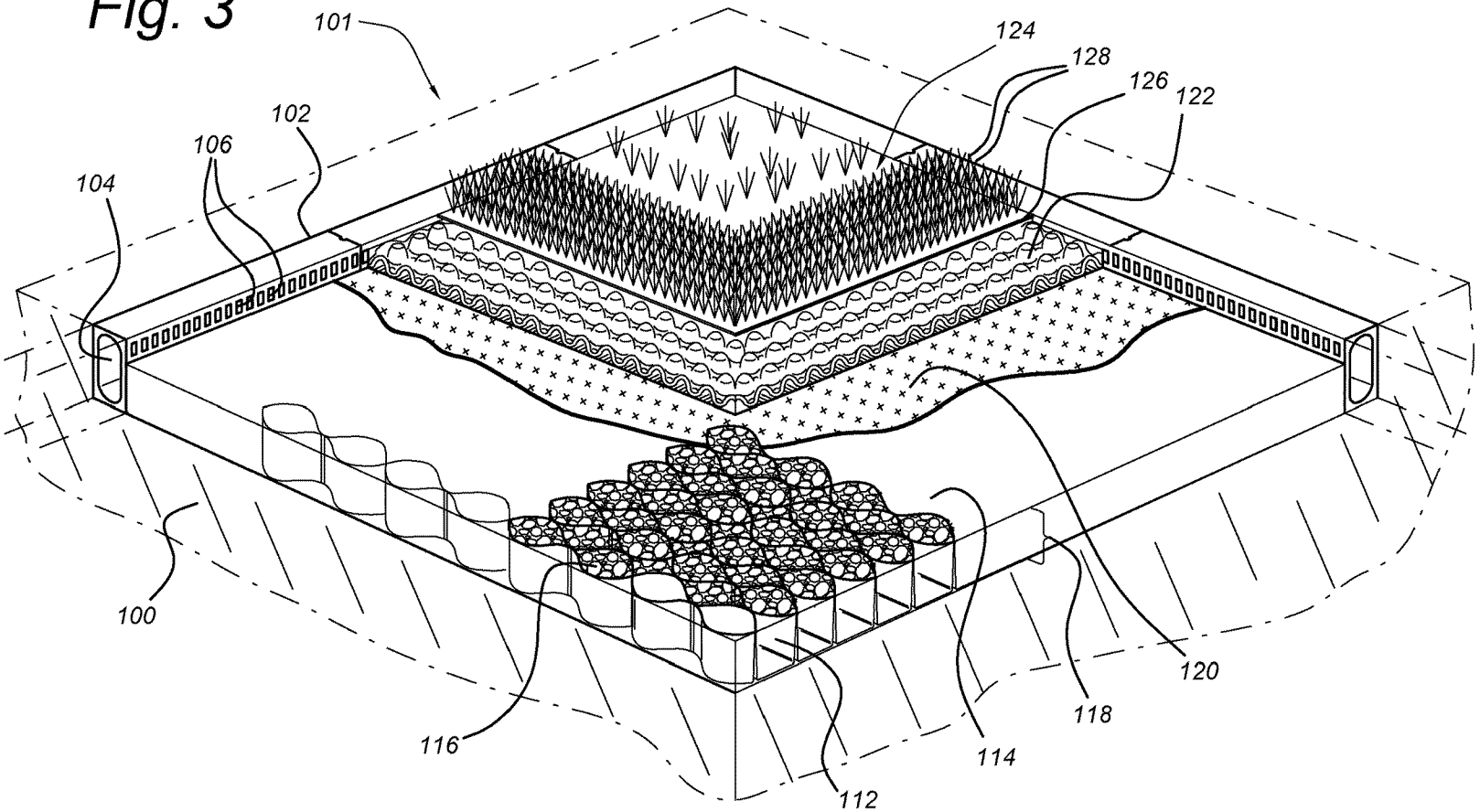
FIG. 3 shows a cut-away perspective view of part of a field according to a second embodiment of the present invention.

An alternative construction of an artificial playing field 101 according to the invention is shown in FIG. 3, where like reference numerals denote similar elements to the first embodiment.

As in the first embodiment, the field 101 comprises a kerb 102, a stabilising layer 112 provided with granular infill 116 to form a stabilised base 118, a separation layer 120, a water distributing layer 122 and an artificial turf layer 124. In this embodiment, the water distributing layer 122 comprises a woven closed cell foam structure of the type shown in WO 2014/092577. This structure includes upstanding loops of closed-cell foam material interwoven with non-foamed fibres as a continuous fabric that can be provided in roll widths of up to 4 m. The upstanding loops offer significant damping qualities whilst allowing good drainage. A further advantage of this water distributing layer 122 is that it can be manufactured on the roll in an unfoamed condition in which it occupies relatively little space. It can be subsequently foamed by application of heat prior to installation.

Thus, the invention has been described by reference to certain embodiments discussed above. It will be recognized that these embodiments are susceptible to various modifications and alternative forms well known to those of skill in the art. In particular, each of the layers may be distinct from the layers depicted to the extent that it performs the same function. Furthermore, where the intended use or the local circumstances make the inclusion of a given layer superfluous, this layer may also be omitted.

Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A modular structure for installing an artificial playing field comprising:

a stabilising layer forming a plurality of compartments for receiving a granular infill, wherein the stabilising layer is a textile layer having pockets including sides and a base, integrally formed together;

an impermeable separation layer for location over the stabilising layer to retain the infill;

a water distributing layer for location over the separation layer, the water distributing layer comprising a flexible resilient layer of closed cell foam material that can be rolled for storage and transport; and an artificial turf layer for location over the water distributing layer, whereby the impermeable separation layer separates the drainage function of the water distributing layer from the stabilising function of the stabilising layer.

2. The structure according to claim 1, wherein the compartments each have an area of between 20 $cm^2$ and 600 $cm^2$.

3. The structure according to claim 1, wherein the compartments each have an area of between 40 $cm^2$ and 200 $cm^2$.

4. The structure according to claim 1, wherein the compartments each have a depth of between 3 cm and 15 cm.

5. The structure according to claim 1, wherein the compartments each have a depth of between 5 cm and 10 cm.

6. The structure according to claim 1, wherein the artificial turf layer is a non-infill turf layer.

7. The structure according to claim 1, wherein the artificial turf layer is a woven turf layer.

8. The structure according to claim 1, for a field of at least 500 $m^2$, provided in a shipping container.

9. The structure according to claim 8, wherein the shipping container is adaptable as a sports facility.

10. A method of installing an artificial playing field comprising:

providing a modular structure according to claim 1;

installing the stabilising layer onto a cleared and leveled surface;

filling the plurality of compartments of the stabilising layer with a granular infill to form a stabilised base;

installing the separation layer over the stabilised base to retain the infill;

installing the water distributing layer over the separation layer; and laying the artificial turf layer.

11. The method of claim 10, wherein the granular infill comprises locally-sourced mineral material.

12. The method according to claim 10, wherein the stabilising layer is a textile layer.

13. The method according to claim 12, wherein the textile layer is a folded textile layer comprising harmonica-like pockets and the method comprises stretching the textile layer across the cleared and leveled surface to open the pockets to form the compartments.

14. An artificial playing field comprising:

a stabilising layer forming a plurality of compartments for receiving a granular infill, wherein the stabilising layer is a textile having pockets including sides and a base, integrally formed together;

a granular infill located within the plurality of compartments;

an impermeable separation layer located over the stabilising layer to retain the infill;

a water distributing layer located over the separation layer, the water distributing layer comprising a flexible resilient layer of closed cell foam material that can be rolled for storage and transport; and an artificial turf layer located over the water distributing layer, whereby the impermeable separation layer separates the drainage function of the water distributing layer from the stabilising function of the stabilising layer.

* * * * *